US005179414A

United States Patent [19]

Bhagat

[11] Patent Number: 5,179,414

[45] Date of Patent: Jan. 12, 1993

[54] APPARATUS FOR DEVELOPING AN IMAGE ON A PHOTOCONDUCTIVE SURFACE

[75] Inventor: Gopal C. Bhagat, Houston, Tex.

[73] Assignee: Compag Computer Corporation, Houston, Tex.

[21] Appl. No.: 641,702

[22] Filed: Jan. 22, 1991

[51] Int. Cl.[5] ..... G03G 15/06

[52] U.S. Cl. ..... 355/259; 118/656; 355/246

[58] Field of Search ..... 355/245, 246, 250, 259, 355/251, 253; 118/653, 656, 657, 658

[56] References Cited

U.S. PATENT DOCUMENTS

| | | | |
|---|---|---|---|
| Re. 30,924 | 5/1982 | Katayama et al. | 15/256.51 |
| 3,859,691 | 1/1975 | Katayama et al. | 15/256.51 |
| 3,985,436 | 10/1976 | Tanaka et al. | 355/309 X |
| 4,100,884 | 7/1978 | Mochizuki et al. | 118/653 |
| 4,514,480 | 4/1985 | Wada et al. | 355/246 |
| 4,538,896 | 9/1985 | Tajima et al. | 355/200 |
| 4,575,221 | 3/1986 | Onoda et al. | 355/200 |
| 4,686,934 | 8/1987 | Kohyama | 118/656 X |
| 4,699,494 | 10/1987 | Honda | 355/211 |
| 4,714,337 | 12/1987 | Nishino et al. | 355/200 |
| 4,822,711 | 4/1989 | Itaya et al. | 118/658 X |
| 4,829,335 | 5/1989 | Kanemitsu et al. | 355/211 |
| 4,835,565 | 5/1989 | Nagatsuna et al. | 355/259 |
| 5,012,289 | 4/1991 | Aldrich et al. | 118/656 X |
| 5,049,471 | 9/1991 | Higashiguchi et al. | 355/251 X |

*Primary Examiner*—A. T. Grimley
*Assistant Examiner*—William J. Royer
*Attorney, Agent, or Firm*—Konneker & Bush

[57] ABSTRACT

An apparatus for developing an image on a photoconductive surface. The apparatus includes a roller positioned adjacent to the photoconductive surface. Negatively charged toner is supplied to the surface of the first roller where the toner electrostatically adheres, either in a uniform layer or a variable layer, to the surface of the first roller. The negatively charged toner electrostatically adhered to the surface of the firt roller is then transferred to the photoconductive surface. The apparatus may also include a second roller held at a positive charge relative to the first roller for electrostatically transferring toner from the second roller to the first roller. Alternately, the positive charge on the second roller relative to the first roller may be produced by placing a negative charge on the first roller or by placing a negtive charge on the second roller and a more negative charge on the second roller. By placing a negative charge on the second roller, the toner will also be negatively charged before transfer to the first roller.

21 Claims, 3 Drawing Sheets

APPARATUS FOR DEVELOPING AN IMAGE ON A PHOTOCONDUCTIVE SURFACE

BACKGROUND OF THE INVENTION

1. Field of the Invention

The invention relates to an electrophotographic printing system and, more particularly, to an electrostatically operative toner transfer system for an electrophotographic printing system.

2. Description of Related Art

Printers provide a means for outputting a permanent record in human readable form. Most printers may be characterized as utilizing either an impact printing technique or a non-impact printing technique. In impact printing techniques, an image is formed by striking an inked ribbon placed near the surface of a sheet of paper. Impact printing techniques may be further categorized as utilizing either formed-character printing or dot-matrix printing. In formed-character printing, the element which strikes the ribbon to produce the image consists of a raised mirror image of the desired character. In dot-matrix printing, the character is formed as a series of closely spaced dots which are produced by striking a provided wire or wires against the ribbon. By selectively striking the provided wires, any character representable by a matrix of dots can be produced.

Non-impact printing is often preferred over impact printing in view of its tendency to provide higher printing speeds as well as its better suitability for printing graphics and half-tone images. Non-impact printing is also relatively noise free. One form of non-impact printing is generally classified as ink jet printing. In this technique, ink is forced, most commonly under pressure, through a tiny nozzle to form a droplet. The droplet is electrostatically charged and is attracted to an oppositely charged platen located behind the sheet of paper. Using electrically controlled deflection plates similar to those in a CRT, the trajectory of the droplet can be controlled to hit a desired spot on the paper. Unused drops are deflected away from the paper into a reservoir for recycling the ink. Due to the small size of the droplet and the precise trajectory control, ink jet printing quality can approach that of formed-character impact printing.

Another non-impact printing technique is generally referred to as electrophotographic printing. In this technique, a controller, for example, a microprocessor associated with a computer system, turns a small laser or other light source on and off at a very rapid rate which readily exceeds millions of times per second. Reflection means, for example, a multifaceted polygonal mirror, reflects the light stream off a facet thereof and sweeps the light stream across a negatively charged print drum. The reflected light discharges portions of the surface of the negatively charged print drum, thereby producing a latent image on the drum. As the print drum rotates, it is dusted with negatively charged toner in the form of small particles. The toner particles stick only to the discharged areas. When negatively charged paper contacts the drum, the toner particles are attracted to the discharged image areas, thereby forming the desired image. The image is then fused to the paper by a combination of heat and pressure. As the finished page is produced, the drum is cleared of its electrical charge, cleaned and recharged for a next cycle.

Various techniques have been utilized to supply toner to a photosensitive surface, for example, the surface of a print drum, where a latent image has been formed. In cascade type developing devices, a developer material which is comprised of carrier material and toner particles is cascaded onto the photosensitive surface from a position above the surface, thereby developing a latent image previously formed on the photoreceptor surface into a visible toner powder image. The use of cascade type developing devices is often undesirable due to the size, slow process speed and somewhat reduced print quality of such devices, particularly when the reproduction of half-tones and solid areas is desired.

Many other techniques utilize magnetic attraction to supply toner to the photosensitive surface of a print drum. For example, U.S. Pat. No. 3,985,436 to Tanaka et al. discloses an electrophotographic copying system in which stationary bar magnets attract developing material consisting of magnetizable carrier material such as iron particles and electroscopic toner particles onto the surface of a cylinder to form magnetic brush bristles. As the cylinder rotates, the brush bristles rub lightly against the latent image formed on the surface of the rotating drum to develop the latent image into a visible toner powder image.

While electrophotographic printing techniques which utilize magnetic developers produce high quality images at relatively fast processing speeds, there remain several drawbacks to such systems. In particular, the brushing action on a print drum produced by a developer roller carrying a developer which includes both toner and carrier tends to wear itself out as well as wear out the print drum. Numerous solutions to this problem have been proposed. For example, U.S. Pat. No. 4,538,896 to Tajima et al. describes a electrophotographic copying system where a hopper supplies a one component magnetic toner to a magnetic roller. In turn, the magnetic roller transfers the toner to a photosensitive drum.

Other solutions avoid the use of magnetic developers entirely. For example, U.S. Pat. No. 4,100,884 to Mochizuki et al. discloses an apparatus for developing an electrostatic image on a photosensitive member in which a one component nonmagnetic toner is supplied to a developer roller. As the surface of the developer roller is formed of an elastic rubber having good adherence and retention qualities for fine powders, the toner is readily attached to the surface of the developer roller as a toner layer. In the event that the deposited toner is not level, a levelling member is included to provide a uniform thickness for the toner layer. The apparatus disclosed by Mochizuki et al. further includes a triboelectric charging member which charges the retained toner to a given polarity. As the electrostatic attraction is greater than the toner retaining capability of the developer roller, the charged toner will then be deposited on the image bearing member.

It is an object of this invention to provide an electrophotographic printing system which includes an electrostatically operative toner transfer system.

It is another object of this invention to provide an electrostatically operative toner transfer system which utilizes relative differences in electrical charges to promote the transfer of toner through the toner transfer system.

It is yet another object of this invention to provide an electrophotographic printing system in which electrostatic attraction is utilized to orientate the toner, thus electrostatically simulating a magnetic brush-like configuration.

SUMMARY OF THE INVENTION

In one embodiment, the present invention is of an apparatus for developing an image on a photoconductive surface which includes a first roller positioned adjacent to the photoconductive surface. Negatively charged toner is supplied to the surface of the first roller where the toner electrostatically adheres to the surface of the first roller. The negatively charged toner is then transferred from the first roller to the photoconductive surface. In one aspect of this embodiment of the invention, the negatively charged toner is supplied to the surface of the first roller by a second roller. The second roller is constructed of a resiliently porous material located below the material from which the first roller is constructed in the triboelectric series. To supply toner to the first roller, the toner is deposited onto the surface of the second roller and temporarily retained therein. In order to enhance toner chargeability, the second roller is preferably slightly biased such that the toner retains its negative charge. A blade compresses the second roller to extract the negatively charged toner temporarily retained therein. Upon extraction, the negatively charged toner is electrostatically attracted to the first roller. In alternate aspects of this embodiment of the invention, a uniform or variable layer of toner may be electrostatically adhered to the surface of the first roller.

In another embodiment, the present invention is of an apparatus for developing an image on a photoconductive surface which includes a toner reservoir, a donor roller constructed of a resiliently porous material and a developer roller constructed of a semi-conductive material. Toner stored in the toner reservoir is deposited onto the surface of the donor roller and temporarily retained therein. The toner is then transferred to the developer roller where it electrostatically adheres to the surface thereof. Finally, the toner is transferred from the surface of the developer roller to the photoconductive surface. In one aspect of this embodiment of the invention, the apparatus further includes means for negatively biasing the developer roller with respect to the donor roller. The negative bias means may be comprised of a single biasing means, such as either a DC or an AC voltage source, for placing a negative charge on the developer roller. Alternatively, the negative biasing means may be comprised of a first biasing means such as a DC voltage source for placing a first negative voltage on the donor roller and a second biasing means, such as either a DC or an AC voltage source, for placing a second negative voltage greater than the first negative voltage on the developer roller. In one specific aspect of this embodiment of the invention, the negative charge on the donor roller is in the range of about −50 to about −500 volts DC and the negative charge on the developer roller is approximately −1000 volts DC. In another specific aspect of this embodiment of the invention, the negative charge on the second roller is approximately 2000 volts AC at a frequency of up to 2.5 KHz.

In still another embodiment of the invention, the present invention is of an apparatus for developing an image on a photoconductive surface which includes a first roller positioned for the electrostatic transfer of toner deposited in a brush like manner on the roller to a photoconductive surface spaced slightly apart from the first roller and means for electrostatically attracting toner to the photoconductive surface in a magnetic brush-like configuration. In one aspect of this embodiment of the invention, the electrostatic attraction means applies an AC voltage and frequency source to the first roller. In another aspect of this embodiment of the invention, a second roller negatively charged such that it is electrostatically viewed as positively charged relative to the first roller is also provided. A negative charge is induced on toner particles supplied to the second roller and the negatively charged toner particles are then electrostatically transferred to the roller.

BRIEF DESCRIPTION OF THE DRAWINGS

The invention may be better understood and its numerous objects, features and advantages become apparent to those skilled in the art by referencing the accompanying drawings in which.

DETAILED DESCRIPTION

Figure 1:
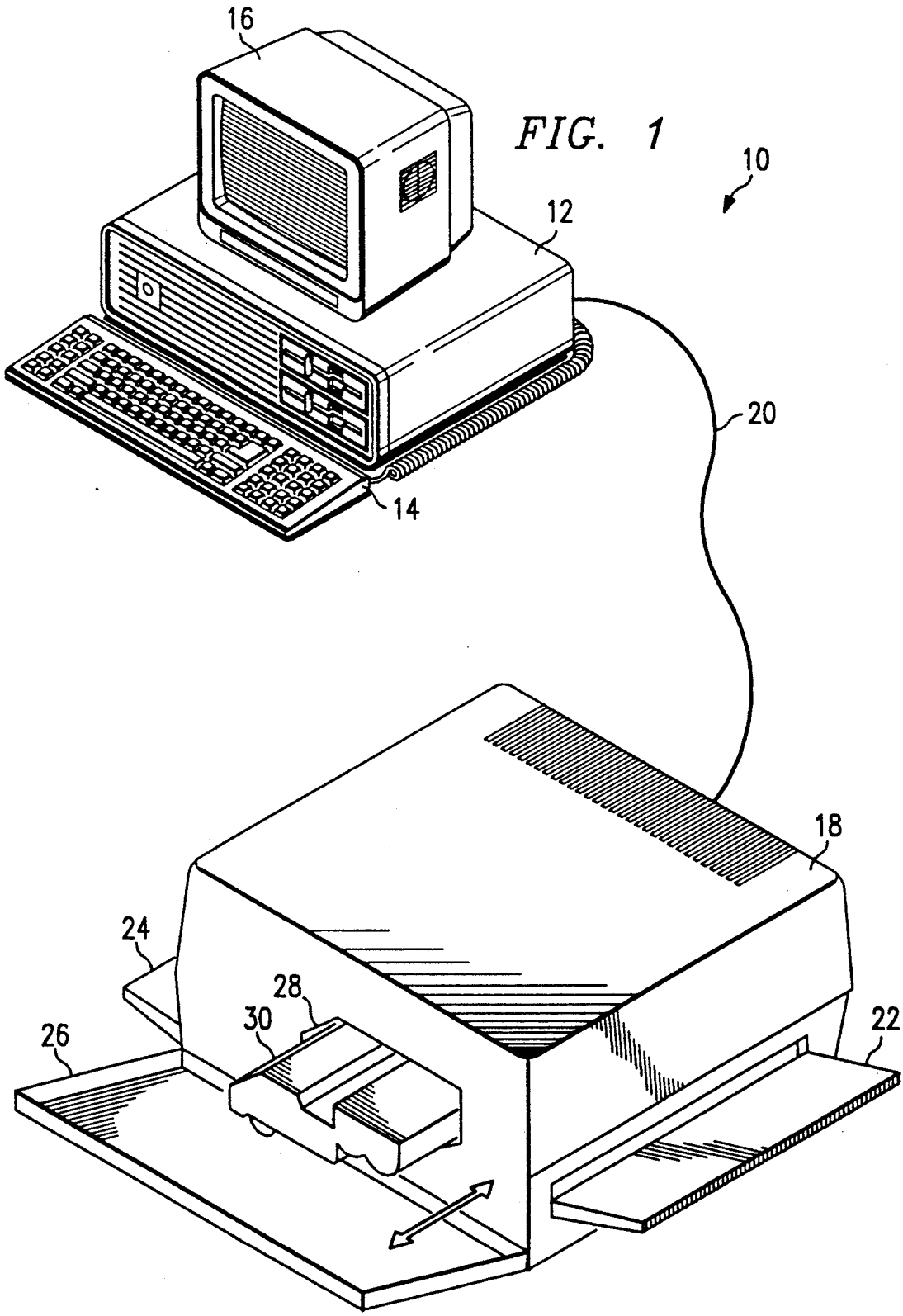
FIG. 1 is a perspective view of a computer system which includes an electrophotographic printer constructed in accordance with the teachings of the present invention.

Referring now to FIG. 1, a computer system 10 which includes a computer 12 provided with both data processing and storage means and electrically connected to a plurality of peripheral devices may now be seen. Typically, the peripheral devices will include a keyboard 14 for inputting data and commands from an operator and a monitor 16 for displaying information. Also connected to the computer 12 is an electrophotographic printer 18 for providing a permanent record of data in human readable form and which is constructed in accordance with the teachings of the present invention. The electrophotographic printer 18 is electrically connected to the computer 12 by a cable 20 which is attached to ports (not shown) provided on the electrophotographic printer 18 and the computer 12, respectively.

During a printing operation, blank sheets of paper are drawn inside the electrophotographic printer 18 from paper supply means 22 such as a paper tray by feed means (not shown). The sheets of paper travel along guide means (not shown) within the electrophotographic printer 18 where, as to be more fully described below, an image is formed thereon. The imprinted sheet is then deposited in an output tray 24 where it may be removed. An access panel 26 provides internal access to the main body of the electrophotographic printer 18. As may be clearly seen in FIG. 1, the main body of the electrophotographic printer 18 includes an opening 28 for receiving an electrophotographic printer cartridge 30 which is utilized to form the aforementioned images on sheets of paper travelling along the guide means. The electrophotographic printer cartridge 30 may be easily removed from the electrophotographic printer 18 for repair, replacement or replenishment of toner and, after servicing, may be readily re-installed therein. As illustrated herein, the electrophotographic printer cartridge 30 is installed from one side of the electrophotographic printer 18. It is equally contemplated, however, that the electrophotographic printer 18 may be configured such that the electrophotographic printer cartridge 30 may be installed via an access panel provided along the top side of the printer. Furthermore, while the electrophotographic printer cartridge 30 is disclosed as part of a printer used to output data from a computer system in a permanent form, it is fully contemplated that the concepts of the present invention may be readily utilized in an electrophotographic copier to produce copies of an image already in permanent form.

Figure 2:
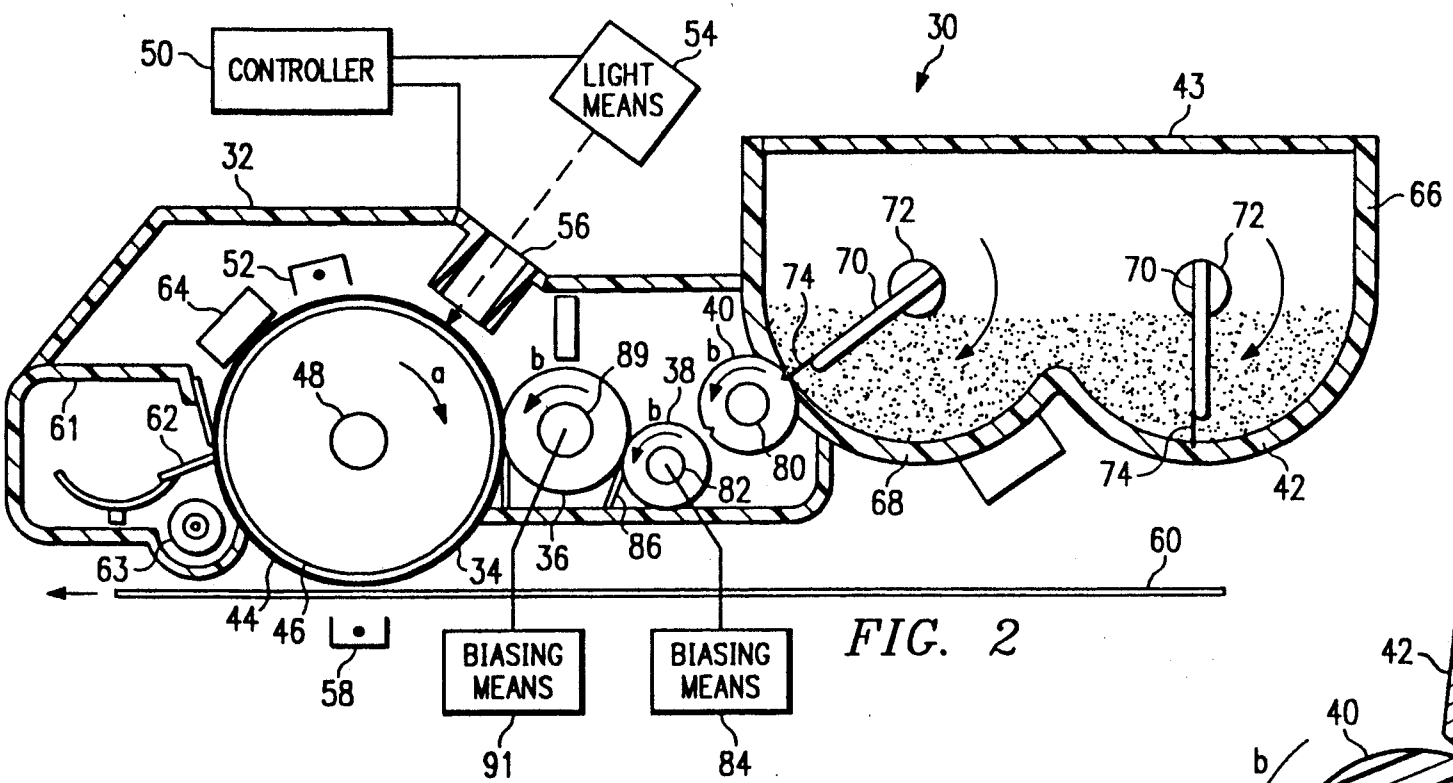
FIG. 2 is a cross-sectional schematic view of the electrophotographic printer illustrated in FIG. 1.

Referring next to FIG. 2, a cross-sectional schematic view of the electrophotographic printer cartridge 30 inserted within the electrophotographic printer 18 may now be seen. As schematically illustrated, the electrophotographic printer cartridge 30 includes a housing 32, preferably formed of a hard plastic material, within which the components of the electrophotographic printer cartridge are housed. Within the cartridge housing 32 and adjacent its left end, a photosensitive drum 34 is positioned. Proceeding rightwardly from the photosensitive drum 34, a rotatable developer roller 36, a rotatable donor roller 38, a feed roller 40 and a toner reservoir 42 are all provided within the cartridge housing 32. The toner reservoir 42 may be integrally formed with the cartridge housing 32 or, in one embodiment, may be provided as a separate cartridge which is removably secured to the cartridge housing 32. Furthermore, in still other alternate embodiments of the invention, the toner reservoir 42 may be provided as a sealed compartment which requires disposal after the toner stored therein has been depleted or may be provided as an accessible compartment which may be refilled with additional toner. For example, the toner reservoir 42 illustrated in FIG. 2 includes a removable lid 43, thereby enabling the toner reservoir 42 to be refilled. Alternately, the lid 43 may be fixedly attached to the toner reservoir 42 but be further provided with a removable cap or other means for accessing the interior of the toner reservoir 42. The photosensitive drum 34 is comprised of a photoconductive layer 44 provided on a conductive drum base 46. Preferably, the photoconductive layer 44 should be a organic photoconductive material. The conductive drum base 46 is mounted on a rotatable shaft 48 such that photosensitive drum 34 is rotatable in a direction "a". To rotate the photosensitive drum 34, a controller 50 would cause drive means (not shown) to rotate the shaft 48. During operation of the electrophotographic printer cartridge 30, the photoconductive drum 34 is rotationally driven in the direction "a" such that the surface of the photoconductive layer 44 passes a scorotron or corona discharger 52 where the surface of the photoconductive layer 44 is uniformly charged with a predetermined polarity suitable for the charging characteristics of the photoconductive layer 44 of the photosensitive drum 34. For example, it is contemplated herein that the corona charger should change the voltage potential at the surface of the photosensitive drum 34 to a voltage in the range of about −700 to −800 volts.

As the photosensitive drum 34 continues to rotate, light generated by light means 54 strikes the photoconductive layer 44. In the embodiment disclosed herein, light means 54 includes a laser light source controlled by the controller 50. Depending on the particular image to be produced, the controller 50 instructs the laser light source to turn on and off rapidly in a pattern related to the desired image. The resultant rays of light are reflected by a series of reflecting mirrors also included as part of light means 54 and directed through an exposure slot 56 formed in the housing 32 where the rays strike the photoconductive layer 44. Wherever the light rays strike, the photoconductive layer 44 is discharged, i.e. reduced to a significantly lower voltage potential having the same polarity. Typically, the light rays would reduce the voltage potential at the surface of the photosensitive drum 34 to a voltage in the range of about −50 volts to about −100 volts. By discharging designated areas, image areas are formed on the photoconductive layer 44. Those areas which are not discharged by the light means 54 form background areas on the photoconductive layer 44. Thusly, photoconductive layer 44 corresponds to the white areas on the paper.

Next, the rotating photosensitive drum 34 contacts the developer roller 36 which is rotating in a direction "b" which is the direction opposite to the direction which the photosensitive drum 34 rotates. As to be more fully described below, a layer of negatively charged toner particles electrostatically adhered to the side surface of the developer roller 36 are electrostatically attracted to the discharged image areas of the photoconductive layer 44. As the discharged image areas on the photoconductive layer 44 are more electrostatically attractive to the toner particles than the surface of the developer roller 36, the toner particles will be transferred to the discharged image areas. The photosensitive drum 34 is then rotated to a position above a transfer charger 58. The transfer corotron 58 emits positive ions onto the backside of the leftwardly moving paper stock 60 passing in close proximity to the photosensitive drum 34, thereby providing sufficient electrostatic attraction such that the toner particles will transfer to the paper stock 60, thereby creating darkened image areas on the paper stock 60. The moving paper stock 60 will then pass over a conventional thermal fusing device (not shown) which thermally fuses the transferred toner particles onto the paper stock 60 and exit from the electrophotographic printer 18.

Mounted within a toner collection housing 61 included as part of the cartridge housing 32 is a scraper blade 62. As the photosensitive drum 34 continues to rotate, the scraper blade 62 strips away any excess toner particles not deposited on the paper stock 60. The toner particles removed by the scraper blade 62 are dropped off the scraper blade 62 onto a rotating auger 63 which transport the toner to the front or rear end of the cartridge 32 where the toner is deposited into a small collection bottle (not shown). Finally, the photosensitive drum 34 rotates past an array 64 of erasure LEDs which remove any residual negative charge on the photoconductive layer 44 before the photoconductive layer 44 is re-charged with a negative charge by the corona discharger 52.

Having described the operation of the photosensitive drum 34, the transfer of toner particles from the toner reservoir 42 to the photosensitive drum 34 shall now be described in detail. In the embodiment of the invention disclosed herein, the toner reservoir 42 may be a dual well reservoir having first and second wells 66 and 68, each filled with toner particles, as illustrated in FIG. 2, or may be a single well reservoir instead. Each well 66, 68 includes an axially extending lifter 70 mounted on a shaft 72. Mounted to the end of each axially extending lifter 70 are flexible blade means 74. When the shafts 72 are rotated by drive means (not shown), the lifters 70 rotates, thereby rotating the flexible blade means 74 through the toner particles stored in each well 66, 68 of the toner reservoir 42. As the lifters 70 rotate, therefore, the flexible blade means 74 forces particles of toner out of the toner reservoir 42 through an aperture 76.

Figure 3A:
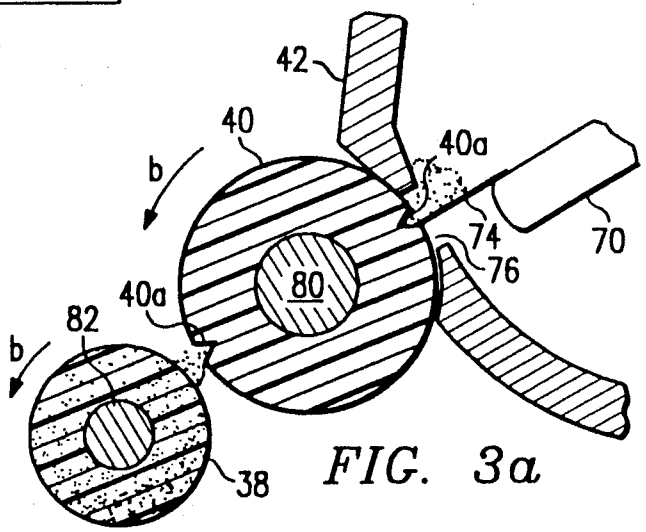
FIG. 3*a* is an enlarged cross-sectional view of the feed and donor rollers illustrated in FIG. 2.

Referring now to FIG. 3*a*, the path of the toner particles exiting the toner reservoir 42 shall now be described in greater detail. Positioned in close proximity to the aperture 76 is the feed roller 40. The feed roller 40 is mounted on a shaft 80 driven by drive means (not shown). As the shaft 80 rotates the feed roller 40 in the direction "b", radially extending grooves 40*a* formed along the surface of the feed roller 40 are filled with toner particles. In the embodiment disclosed herein, the feed roller 40 is provided with first and second generally V-shaped grooves formed therein. It is fully contemplated, however, that additional grooves may be formed in the feed roller 40 to increase the rate at which the feed roller 40 supplies toner to the donor roller 38. In one aspect of the invention, it is contemplated that the feed roller 40 may should be constructed of a material having a higher or more positive position in the triboelectric series than the material from which the donor roller 38 is constructed. By doing so, the feed roller 40 will donate electrons to the donor roller 38, thereby charging it negatively. For example, it is contemplated that the feed roller 40 may be constructed from a polyamide material.

Figure 3B:
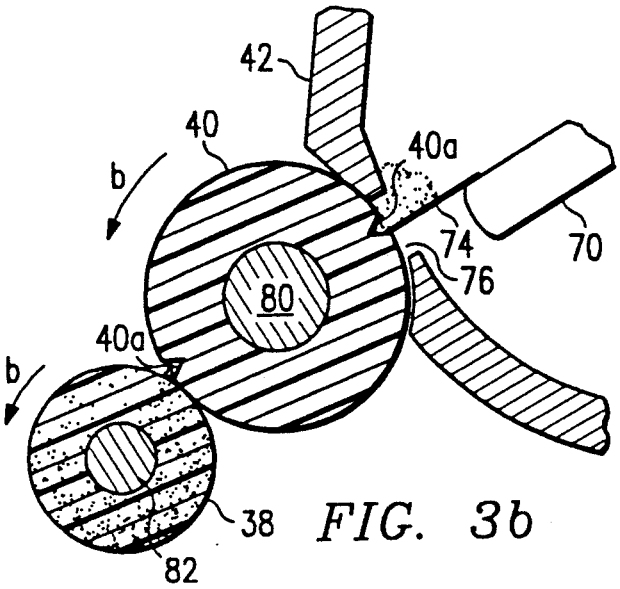
FIG. 3*b* is an enlarged, cross-sectional view of an alternative embodiment of the feed and donor rollers of FIG. 3*a;*

As the feed roller 40 continues to rotate, the toner particles which have been forced into the aperture 76 and which have filled the groove 40*a* are transported to the donor roller 38. The remaining particles of toner are forced by the sidewalls which define the aperture 76 to remain in the toner reservoir 42. In the embodiment of the invention illustrated in FIG. 3*a*, the surfaces of the feed roller 40 and the donor roller 38 are spaced apart. In this embodiment, as the feed roller 40 rotates, the toner particles stored in the generally V-shaped groove 40*a* are dumped onto the donor roller 38. In an alternate embodiment of the invention illustrated in FIG. 3*b*, the surfaces of feed roller 40 and the donor roller 38 frictionally engage each other. As the surfaces of the feed roller 40 and the donor roller 38 frictionally engaged with each other, the triboelectric charge generated thereby will negatively charge toner particles being carried in the grooves 40*a* of the feed roller 40 and deposited onto the surface of the donor roller 38.

The donor roller 38 is rotatable mounted on an electrically conductive shaft 82 driven by drive means (not shown). The donor roller 38 is formed of a resilient porous material which meets the triboelectric series requirements previously discussed. For example, the donor roller 38 may be formed from a polyurethane foam. As the donor roller 38 is porous, the particles of toner deposited on the surface of the donor roller 38 are temporarily retained on the surface of the donor roller 38. Preferably, the resilient porous material should be selected to have a porosity in the range of 20–30 pores per inch. in one embodiment of the invention, the electrically conductive shaft 82 of the donor roller 38 may be connected to a first biasing means 84 such as a DC voltage source. For example, it is contemplated that a negative bias up to −500 volts may be applied to the donor roller 38. By applying a negative bias to the donor roller 38, the toner particles carried thereby retain its negative charge.

Figure 4:
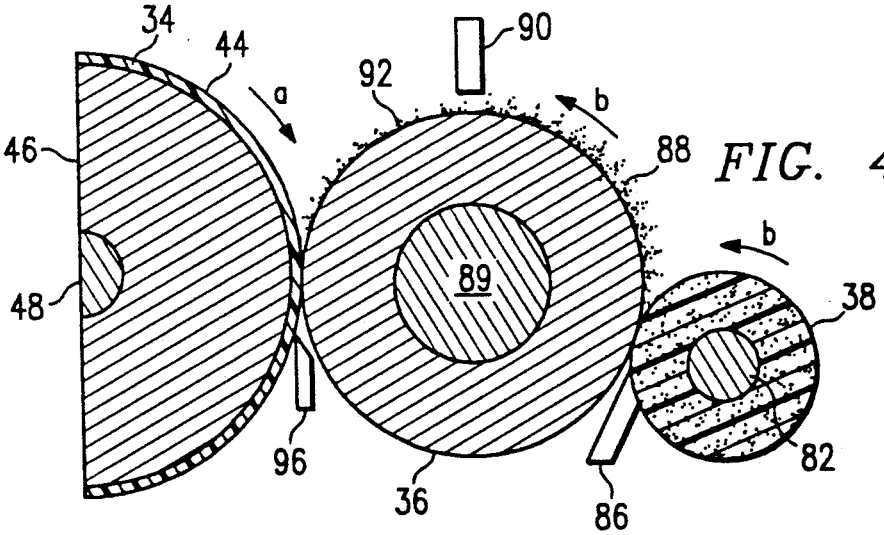
FIG. 4 is a first enlarged cross-sectional view of the donor and developer rollers illustrated in FIG. 2.

Referring now to FIG. 4, the temporarily retained toner particles are then carried in a direction "b" by the rotating donor roller 38 until transferred to the developer roller 36 in a manner to be more fully described below. To encourage the transfer of toner particles from the donor roller 38 to the developer roller 36, it is preferred that the donor roller 38 be constructed of a material having a lower or less positive position in the triboelectric series than the material from which the developer roller 36 is constructed. Preferably, the developer roller 36 should have a relative hardness of 50–70 durometers and a specific resistivity in the range of $10^4$ to $10^8$ ohm-cm. For example, it is contemplated that the developer roller may be constructed from neoprene or urethane. In one embodiment. The developer roller 36 may be configured to include a base section capable of conducting electricity and a sleeve formed from a semi-conductive material.

A blade 86 is mounted to the cartridge housing 32 and orientated such that the tip of the blade is positioned between the donor roller 38 and the developer roller 36. Preferably, the blade 86 should be formed of a relatively stiff material such as cellulose acetate or its equivalent. As the donor roller 38 rotates, the blade 86 compresses the resiliently porous donor roller 38, thereby forcing negatively charged toner particles temporarily retained therein to the surface of the donor roller 38. As the surfaces of the developer roller 36 and the donor roller 38 frictionally engage each other, the relative positions of the donor roller 38 and the developer roller 36 on the triboelectric ladder will cause the developer roller 36 to develop a negative charge with respect to the donor roller 38. As a result, the low negatively charged toner particles on the surface of the donor roller 38 will be electrostatically attracted to the surface of the high negatively biased developer roller 36.

Returning momentarily to FIG. 2, it is further contemplated that, in one embodiment of the invention, the developer roller 36 is rotatably mounted on an electrically conductive shaft 89. A second biasing means 91 is electrically connected to the conductive shaft 89. The second biasing means 91 is selected such that it will be able to apply a negative bias to the developer roller 36 which is more negative than the negative bias applied to the donor roller 38. By applying a greater negative charge to the developer roller, the electrostatic attraction of the negatively charged toner particles to the developer roller 36 is strengthened. Furthermore, the negative charge prevents degradation of the electrostatic attraction of the toner particles to the developer roller 36 which could result from the presence of increasing levels of humidity. Generally, increases in humidity cause the triboelectric ladder to effectively shrink. As a result, materials on the lower end of the triboelectric ladder acquire less of a negative charge relative to materials placed higher on the ladder. Thus, the effect of an increase in humidity would be to weaken the electrostatic attraction of the negatively charged toner particles to the developer roller 36. By placing a greater negative charge on the developer roller 36 than the negative charge placed on the donor roller 38, the greater negative charge can compensate for losses in electrostatic attraction which could potentially result from increases in humidity.

Referring again to FIG. 4, an additional aspect of this embodiment of the invention shall now be described in detail. Here, it is preferred that the developer roller 36 is spaced slightly apart from the photosensitive drum 34. In this embodiment, the second biasing means 91 is an AC source used to apply an AC voltage and frequency on the developer roller 36. For example, it is contemplated that the second biasing means 91 may apply up to 2000 volts AC and up to a frequency of 2,500 Hz on the developer roller 36. By applying the Ac voltage to the developer roller 36, the toner particles adhering to the surface of the developer roller 36 are orientated in a series of axially extending bristles 88 which closely resemble the pulsating, brush configuration which is more typically produced by a magnetic brush developer system in which a carrier is utilized to adhere toner particles to a magnetically charged developer roller. Further, the configuration of the bristles 88 on the developer roller 36 may be readily controlled by the second biasing means 91. Specifically, the height of the bristles 88 may be modified by changing the amplitude of the applied AC voltage and the separation or rate of pulsation between successive bristles 88 may be modified by changing the frequency of the applied AC voltage. Modification of the toner adhering to the developer roller 36 is possible because not all toner particles carried by the donor roller 38 receive a defined polarity during the transfer process. Those not receiving a defined polarity typically remain adhered to the donor roller 38 for at least one additional rotation. Thus, by increasing the voltage, the number of toner particles receiving a defined polarity, and thereby the number of toner particles transferring to the developer roller 36 increases.

Figure 5:
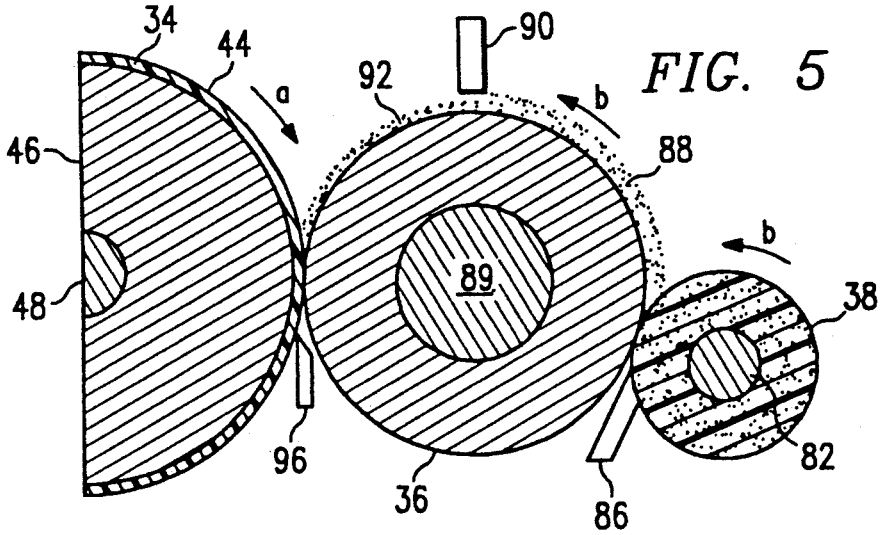
FIG. 5 is a second enlarged cross-sectional view of the donor and developer rollers illustrated in FIG. 2.

In yet another aspect of the invention illustrated in FIG. 5, second biasing means 86 places a DC voltage on the developer roller 36. Under the influence of a DC voltage, a uniform layer of toner particles would adhere to the surface of the developer roller 36. In either aspect of the invention, as the developer roller 36 rotates, the toner particles adhered to the surface thereto, would pass in closed proximity to an electrostatic metering blade 90. Preferably, the electrostatic metering blade 90 should be constructed of a conductive material and be mounted to the insulative cartridge housing 32. If found necessary, a reinforcing negative voltage in the range of 0 to −500 volts may be applied to the electrostatic metering blade 90, to more effectively excise excess toner particles adhering to the surface of the developer roller 36 such that the layer of toner particles 92, either uniform or brush-like, which remain adhered to the developer roller 36 may reduce to approximately the thickness of 1–2 toner particles (about 15–30 micrometers). Excised toner particles would be reabsorbed by the donor roller 38 for retransfer to the developer roller 36. The toner particles 92 which remain adhered to the developer roller 36 would then be deposited onto the photosensitive drum 34 in accordance with the methods previously described. Toner particles not deposited onto the photosensitive drum 34 would be returned to the developer roller 36. More specifically, a flexible seal 96 mounted to the cartridge housing 32 and positioned between the photosensitive drum 34 and the developer roller 36 is provided to contain any toner dropped by the developer roller 36.

It has been discovered that by reducing the separation between bristles 88 of toner particles, the speed at which the development process can operate is increased. It has been further discovered that by producing a brush-like configuration of the toner electrostatically adhering to the developer roller 36, a high quality image is developed on the photosensitive drum 34. In traditional development processes, while the majority of the toner particles are deposited on the low negative charge image areas formed on the photoconductive layer 44, a few of the toner particles end up deposited on the high negative charge background areas. As the negatively charged toner particles adhering to the developer roller 36 in the brush-like configuration pass in closed proximity to the photosensitive drum 34, toner particles adhering to the high negative charge background areas would view the bristles 88 as a positive charge. The bristles 88 would electrostatically attract or "scavenge" the toner particles adhering to the background, thereby remove stray toner particles improperly deposited on the background areas. Then, when bristles 88 pass in close proximity to the low negative charge image areas, the scavenged toner particles would be redeposited onto the image areas, thus improving the contrast between image and background areas.

Thus, there has been described and illustrated herein an electrostatically operative toner transfer system for use in an electrophotographic printer in which the exploitation of relative differences in electrical charges on the system components and triboeletric charges resulting between the system components are utilized to produce an electrophotographic printer which transfers toner by electrostatic attraction, thereby eliminating wear the photoconductive drum produced by the use of carriers to magnetically transfer toner and which is less susceptible to humidity. Furthermore, by the application of an AC bias to the developer roller, the electrostatically attracted toner particles may be orientated in a magnetic brush-like configuration which permits increased operating speeds and improved image quality. However, those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. An apparatus for developing an image on a photoconductive surface, comprising:

a roller positioned for the electrostatic transfer of toner deposited on said roller to said photoconductive surface;

means for electrostatically attracting a layer of toner to the surface of said roller, said electrostatically attracted layer of toner being of varying thickness and adhering to the surface of said roller in a magnetic brush-like configuration; and a second roller positioned for frictional engagement with said roller, said second roller positively charged relative to said roller;

wherein toner supplied to said second roller is electrostatically transferred to said roller in said magnetic brush-like configuration.

2. An apparatus according to claim 1, wherein said means for electrostatically attracting a layer of toner to the surface of said roller further comprises an AC voltage source electrically connected to said roller.

3. An apparatus according to claim 1 and further comprising electrostatic metering means for reducing the thickness of said layer of negatively charged toner electrostatically deposited to the surface of said roller in said magnetic brush-like configuration.

4. An apparatus according to claim 1 and further comprising means for inducing a negative charge on toner supplied to said second roller prior to electrostatic transfer of said negatively charged toner to said roller in said magnetic brush-like configuration.

5. An apparatus according to claim 4 wherein said means for inducing a negative charge on toner supplied to said second roller further comprises a DC voltage source for placing a negative bias on said second roller which is less negative than the negative bias placed on said roller.

6. An apparatus for developing an image on a photoconductive surface, comprising:

a first roller constructed of a first material and mounted on a first conductive shaft, said first roller positioned adjacent to said photoconductive surface;

a second roller constructed of a second material higher in the triboelectric series than said first material and mounted on a second conductive shaft, said first and second rollers positioned such that the surfaces thereof frictionally engage each other;

means for depositing toner on the surface of said second roller, said second roller constructed of a resilient porous material which temporarily retains said toner deposited thereon;

a first voltage source electrically connected to said second conductive shaft, said first voltage source placing a negative biasing voltage on said second roller such that said toner carried thereby retains a negative charge;

said frictional engagement between said first and second rollers electrostatically attracting said negatively charged toner deposited on and carried by said second roller to the surface of said first roller;

a second voltage source electrically connected to said first conductive shaft, said second voltage source placing a negative biasing voltage on said first roller which exceeds the negative biasing voltage placed on said second roller, said second voltage source adhering said electrostatically attracted toner to the surface of said first roller in a layer; and means for transferring said negatively charged toner electrostatically adhered to the surface of said first roller to said photoconductive surface.

7. An apparatus according to claim 6 and further comprising blade means for compressing said second roller to extract negatively charged toner temporarily retained thereby, said negatively charged toner being electrostatically attracted to said first roller upon extraction.

8. An apparatus according to claim 6 and further comprising electrostatic metering means for reducing the thickness of said layer of negatively charged toner electrostatically adhered to the surface of said first roller.

9. An apparatus according to claim 6 wherein said second voltage source further comprises a DC voltage source electrically connected to said second conductive shaft, said DC voltage source electrostatically adhering a uniform layer of said negatively charged toner to the surface of said first roller.

10. An apparatus according to claim 6 wherein said first and second voltage sources further comprise first and second DC voltage sources electrically connected to said second and first conductive shafts, respectively, said second DC voltage source electrostatically adhering a uniform layer of said negatively charged toner to the surface of said first roller.

11. An apparatus according to claim 10 wherein a negative charge in the range of about −50 volts to about −500 volts is placed on said second roller by said first DC voltage source and a negative charge of approximately −1000 volts is placed on said first roller by said second DC voltage source.

12. An apparatus for developing an image on a photoconductive surface, comprising;

a first roller constructed of a first material, said first roller positioned adjacent to said photoconductive surface;

a second roller constructed of a second material higher in the triboelectric series than said first material, said first and second rollers positioned such that the surfaces thereof frictionally engage each other;

means for depositing toner on the surface of said second roller, said second roller constructed of a resilient porous material which temporarily retains said toner deposited thereon;

a first voltage source electrically connected to said second roller, said first voltage source placing a negative biasing voltage on said second roller such that said toner deposited thereon and carried thereby retains a negative charge;

said frictional engagement between said first and second rollers electrostatically attracting said negatively charged toner deposited on and carried by said second roller to the surface of said first roller;

means for electrostatically adhering a variable layer of said negatively charged toner to the surface of said first roller; and means for transferring said negatively charged toner electrostatically adhered to the surface of said first roller in a variable layer to said photoconductive surface.

13. An apparatus according to claim 12 and further comprising electrostatic metering means for reducing the thickness of said layer of negatively charged toner electrostatically adhered to the surface of said second roller and means for biasing said electrostatic metering means in the range of 0 to −500 volts.

14. An apparatus according to claim 12 wherein said means for electrostatically adhering a variable layer of said negatively charged toner to the surface of said first roller further comprises an AC voltage source electrically connected to said first rollers.

15. An apparatus according to claim 14 wherein said variable layer of said negatively charged toner is provided in a magnetic brush-like configuration and said apparatus further comprises means for adjusting the frequency and amplitude of said magnetic brush-like toner configuration.

16. An apparatus according to claim 15 wherein said first voltage source is a DC voltage source electrically connected to said second roller.

17. An apparatus according to claim 16 wherein a negative change in the range of about −50 volts to about −500 volts is placed on said second roller by said DC voltage source and a charge of approximately 2000 volts is placed on said first roller by said Ac voltage source.

18. An apparatus according to claim 17 and further comprising means for modifying the frequency of said charged placed on said first roller by said AC voltage source.

19. An apparatus according to claim 18 wherein a charge of approximately 2000 volts at a frequency up to 2500 Hz is placed on said first roller by said AC voltage source.

20. An apparatus for developing an image on a photoconductive surface, comprising:

a first roller constructed of a first material and mounted on a first conductive shaft, said first roller positioned adjacent to said photoconductive surface;

a second roller constructed of a second material higher in the triboelectric series than said first material and mounted on a second conductive shaft, said first and second rollers positioned such that the surfaces thereof frictionally engage each other;

a third roller constructed of a third material higher in the triboelectric series than said second material, said second and third rollers positioned such that the surfaces thereof frictionally engage each other, said third roller having a plurality of radially extending apertures formed on the surface thereon;

means for supplying toner to the surface of said third roller, said toner filling said apertures and being carried by said third roller until electrostatically attracted to the surface of said second roller by the frictional engagement of said second and third rollers, said second roller constructed of a resilient porous material which temporarily retains said toner deposited thereon;

a first shaft voltage source electrically connected to said second conductive shaft, said first voltage source placing a negative biasing voltage on said second roller such that said toner carried thereby retains a negative charge;

said frictional engagement between said first and second rollers electrostatically attracting said negatively charged toner deposited on and carried by a second roller to the surface of said first roller;

a second voltage source electrically connected to said first conductive shaft, said second voltage source placing a negative biasing voltage on said first roller which exceeds the negative biasing voltage placed on said second roller, said second voltage source adhering said electrostatically attracted toner to the surface of said first roller in a layer; and means for transferring said negatively charged toner electrostatically adhered to the surface of said first roller to said photoconductive surface.

21. An apparatus according to claim 20 wherein said radially extending apertures are generally V-shaped.

* * * * *

UNITED STATES PATENT AND TRADEMARK OFFICE

CERTIFICATE OF CORRECTION

PATENT NO. : 5,179,414

DATED : January 12, 1993

INVENTOR(S) : Bhagat, Gopal C.

It is certified that error appears in the above-identified patent and that said Letters Patent is hereby corrected as shown below:

Column 3, line 48, "Alternatively," should be --Alternately,--.

Column 7, line 45, "engaged" should be --engage--.

Column 7, line 61, "in" should be --In--.

Column 9, line 6, "Ac" should be --AC--.

Column 9, line 38, "closed" should be --close--.

Column 10, line 8, "closed" should be --close--.

Column 10, line 14, "when" should be --when the--.

Column 12, line 63, "Ac" should be --AC--.

Column 12, line 67, "charged" should be --charge--.

Column 14, line 4, "first shaft voltage" should be --first voltage--.

Column 14, line 11, "a" should be --said--.

Signed and Sealed this

Eighteenth Day of January, 1994

*Attest:*

Bruce Lehman

BRUCE LEHMAN

*Attesting Officer*

*Commissioner of Patents and Trademarks*